US006972639B2

(12) United States Patent
Podell

(10) Patent No.: US 6,972,639 B2
(45) Date of Patent: Dec. 6, 2005

(54) BI-LEVEL COUPLER

(75) Inventor: Allen F. Podell, Palo Alto, CA (US)

(73) Assignee: Werlatone, Inc., Brewster, NY (US)

( * ) Notice: Subject to any disclaimer, the term of this patent is extended or adjusted under 35 U.S.C. 154(b) by 36 days.

(21) Appl. No.: 10/731,174

(22) Filed: Dec. 8, 2003

(65) Prior Publication Data

US 2005/0122185 A1 Jun. 9, 2005

(51) Int. Cl.[7] ..... H01P 5/18
(52) U.S. Cl. ..... 333/112; 333/116
(58) Field of Search ..... 333/25, 26, 109, 333/110, 112, 113, 116, 117

(56) References Cited

U.S. PATENT DOCUMENTS

| | | | | |
|---|---|---|---|---|
| 3,319,190 | A | 5/1967 | Shively | 333/115 |
| 3,345,585 | A | 10/1967 | Hildebrand | 333/116 |
| 3,371,284 | A | 2/1968 | Engelbrecht | 330/286 |
| 3,516,024 | A | 6/1970 | Lange | 333/116 |
| 3,534,299 | A | 10/1970 | Eberhardt | 333/24.2 |
| 3,678,433 | A | 7/1972 | Hallford | 333/203 |
| 3,904,991 | A | 9/1975 | Ishii et al. | 333/116 |
| 3,967,220 | A | 6/1976 | Tagashira et al. | 333/28 R |
| 3,999,150 | A | 12/1976 | Caragliano et al. | 333/116 |
| 4,158,184 | A | 6/1979 | Kenyon | 333/208 |
| 4,216,446 | A | 8/1980 | Iwer | 333/112 |
| 4,394,630 | A | 7/1983 | Kenyon et al. | 333/116 |
| 4,482,873 | A | 11/1984 | Nyhus | 333/116 |
| 4,777,458 | A | 10/1988 | Pardini | 333/112 |
| 4,800,345 | A | 1/1989 | Podell et al. | 333/111 |
| 4,937,541 | A | 6/1990 | Podell et al. | 333/116 |
| 4,999,593 | A | 3/1991 | Anderson | 333/112 |
| 5,075,646 | A | 12/1991 | Morse | 333/116 |
| 5,369,379 | A | 11/1994 | Fujiki | 333/116 |
| 5,451,914 | A * | 9/1995 | Stengel | 333/25 |
| 5,557,245 | A | 9/1996 | Taketa et al. | 333/116 |
| 5,563,558 | A | 10/1996 | Mohwinkel et al. | 333/127 |
| 5,634,208 | A | 5/1997 | Nishikawa et al. | 455/327 |
| 5,689,217 | A | 11/1997 | Gu et al. | 333/116 |
| 5,742,210 | A | 4/1998 | Chaturvedi et al. | 333/116 |
| 5,781,071 | A * | 7/1998 | Kusunoki | 330/269 |

(Continued)

OTHER PUBLICATIONS

An, Hongming et. al, *IA 50: 1 Bandwidth Cost-Effecitve Coupler with Sliced Coaxial Cable*, IEEE MTT-S Digest, pp. 789-792, Jun. 1996.

(Continued)

*Primary Examiner*—Dean Takaoka
(74) *Attorney, Agent, or Firm*—Kolisch Hartwell, P.C.

(57) ABSTRACT

A coupler is disclosed that includes first and second mutually coupled spirals disposed On opposite sides of a dielectric substrate. The substrate may be formed of one or more layers and the coils may have a number of turns appropriate for a given application. Conductors forming the spirals may be opposite each other on the substrate and each spiral may include one or more portions on each side of the substrate. Each conductor of the coupler may include an intermediate portion having a width that is more than the width of end portions. An extension may extend from each respective intermediate portion, with the two extensions extending in non-overlapping relationship.

41 Claims, 4 Drawing Sheets

U.S. PATENT DOCUMENTS

| | | | | |
|---|---|---|---|---|
| 5,793,272 | A | 8/1998 | Burghartz et al. | 336/200 |
| 5,841,328 | A | 11/1998 | Hayashi | 333/116 |
| 5,852,866 | A | 12/1998 | Kuettner et al. | 29/608 |
| 5,889,444 | A | 3/1999 | Johnson et al. | 333/127 |
| 5,926,076 | A | 7/1999 | Johnson et al. | 333/109 |
| 5,982,252 | A | 11/1999 | Werlau | 333/127 |
| 6,020,783 | A | 2/2000 | Coppola | 327/556 |
| 6,246,299 | B1 | 6/2001 | Werlau | 333/127 |
| 6,342,681 | B1 | 1/2002 | Goldberger et al. | 174/261 |
| 6,346,863 | B2 | 2/2002 | Sasaki et al. | 333/116 |
| 6,396,362 | B1 * | 5/2002 | Mourant et al. | 333/25 |
| 6,407,647 | B1 | 6/2002 | Apel et al. | 333/25 |
| 6,407,648 | B1 | 6/2002 | Johnson | 333/127 |
| 6,483,397 | B2 | 11/2002 | Catoiu | 333/116 |
| 6,515,556 | B1 | 2/2003 | Kato et al. | 333/116 |
| 6,518,856 | B1 | 2/2003 | Casale et al. | 333/124 |
| 6,522,222 | B1 | 2/2003 | Pchelnikov et al. | 333/161 |
| 6,580,334 | B2 | 6/2003 | Simburger et al. | 333/24 R |
| 6,642,809 | B2 | 11/2003 | Shin et al. | 333/116 |
| 6,686,812 | B2 | 2/2004 | Gilbert et al. | 333/112 |
| 6,747,525 | B2 | 6/2004 | Iida et al. | 333/116 |
| 6,756,860 | B2 | 6/2004 | Shin | 333/116 |
| 6,765,455 | B1 | 7/2004 | De Lillo et al. | 333/116 |
| 6,771,141 | B2 | 8/2004 | Iida et al. | 333/116 |
| 6,794,954 | B2 | 9/2004 | Gurvich et al. | 333/116 |
| 6,806,558 | B2 | 10/2004 | Apel | 257/663 |
| 6,806,789 | B2 | 10/2004 | Bawell et al. | 333/117 |
| 6,819,200 | B2 * | 11/2004 | Zhao et al. | 333/25 |
| 6,822,532 | B2 | 11/2004 | Kane et al. | 333/116 |

OTHER PUBLICATIONS

Walker, J.L.B., *Analysis and Design of Kemp-Type 3 dB Quadrature Couplers*, IEEE Transactions on Microwave Theory Techniques, vol. 38, No. 1, pp. 88-90, Jan. 1990.

Bickford, Joel D. et. al, *Ultra-Braodband High-Directivity Directional Coupler Design*, IEEE MTT-S Digest, pp. 595-598, 1988.

Young, Leo, *The analytical equivalence of TEM-mode directional couplers and transmission-line stepped-impedance filters*, Proceedings IEEE, vol. 110, No. 2, pp. 275-281, Feb. 1963.

Levy, Ralph, *General Synthesis of Asymmetric Multi-Element Coupled-Transmission-Line Directional Couplers*,* IEEE Transactions on Microwave Theory and Techniques, vol. MTT-11, No. 4, pp. 226-237, Jul. 1963.

Monteath, G.D., *Coupled Transmission Lines as Symmetrical Directional Couplers*, Proc. IEE, vol. 102, Part B, No. 3, pp. 383-392, May 1955.

Oliver, Bernard M., *Directional Electromagnetic Couplers*,* Proc. IRE, vol. 42., No. 11, pp. 1686-1692, Nov. 1954.

Gerst, C.W., *11-7 Electrically Short 90° Couplers Utilizing Lumped Capacitors*, Syracuse University Research Corporation, pp. 58-62, (year unknown).

* cited by examiner

Fig. 1
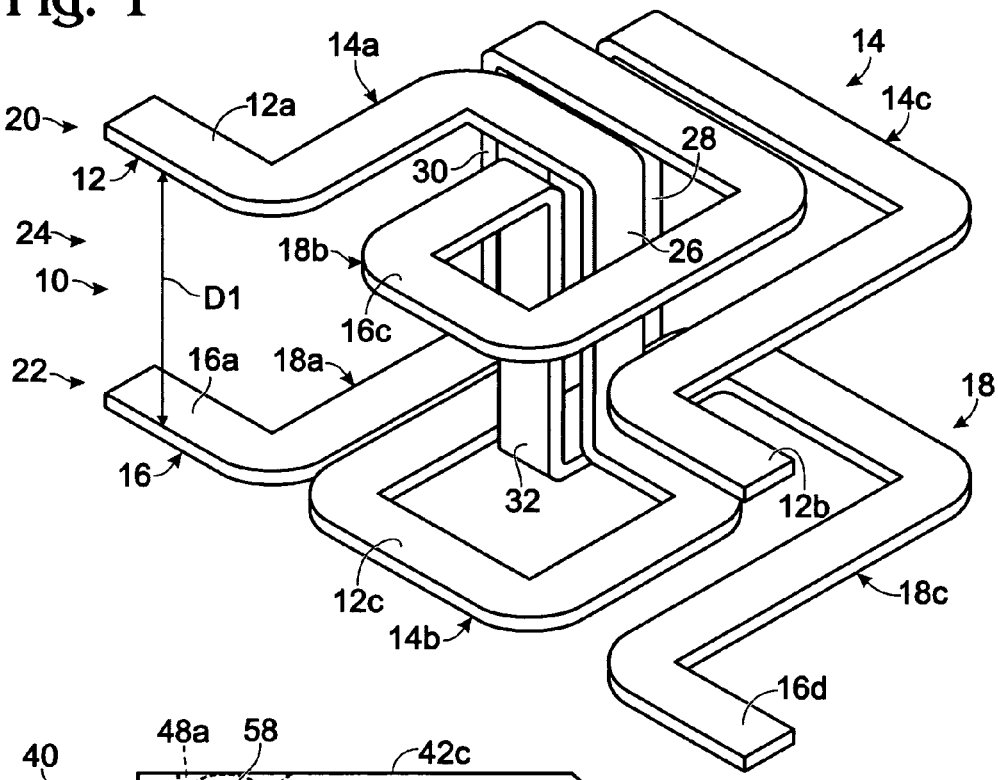
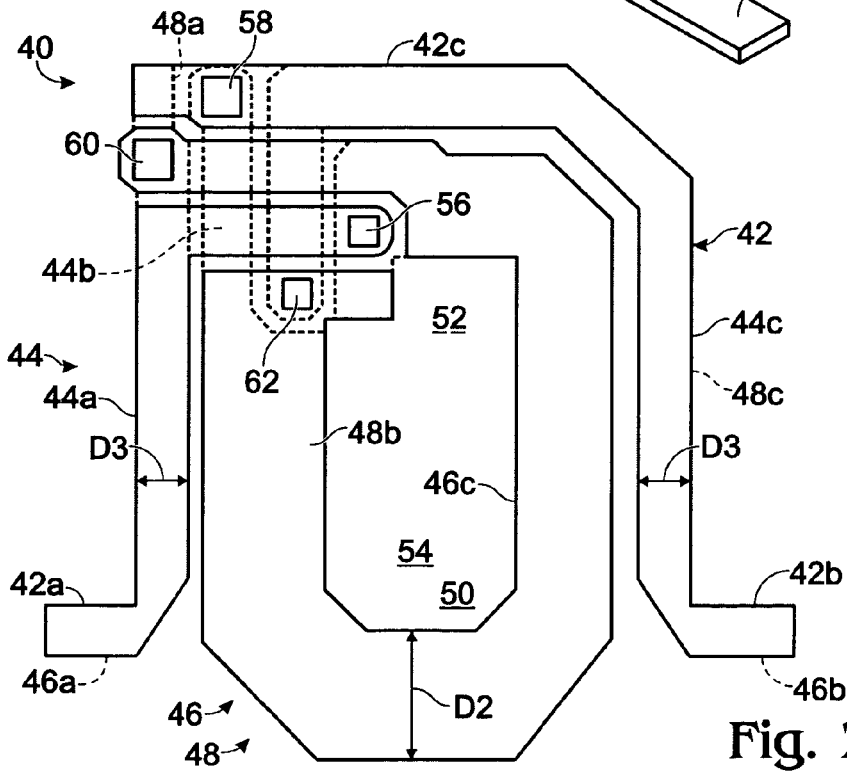
Fig. 2

BI-LEVEL COUPLER

BACKGROUND

A pair of conductive lines are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling.

Couplers are electromagnetic devices formed to take advantage of coupled lines, and may have four ports, one associated with each end of two coupled lines. A main line has an input connected directly or indirectly to an input port. The other end is connected to the direct port. The other or auxiliary line extends between a coupled port and an isolated port. A coupler may be reversed, in which case the isolated port becomes the input port and the input port becomes the isolated port. Similarly, the coupled port and direct port have reversed designations.

Directional couplers are four-port networks that may be simultaneously impedance matched at all ports. Power may flow from one or the other input port to the corresponding pair of output ports, and if the output ports are properly terminated, the ports of the input pair are isolated. A hybrid is generally assumed to divide its output power equally between the two outputs, whereas a directional coupler, as a more general term, may have unequal outputs. Often, the coupler has very weak coupling to the coupled output, which reduces the insertion loss from the input to the main output. One measure of the quality of a directional coupler is its directivity, which is the ratio of the desired coupled output to the isolated port output.

Adjacent parallel transmission lines couple both electrically and magnetically. The coupling is inherently proportional to frequency, and the directivity can be high if the magnetic and electric couplings are equal. Longer coupling regions increase the coupling between lines, until the vector sum of the incremental couplings no longer increases, and the coupling will decrease with increasing electrical length in a sinusoidal fashion. In many applications it is desired to have a constant coupling over a wide band. Symmetrical couplers exhibit inherently a 90-degree phase difference between the coupled output ports, whereas asymmetrical couplers have phase differences that approach zero-degrees or 180-degrees.

Unless ferrite or other high permeability materials are used, greater than octave bandwidths at higher frequencies are generally achieved through cascading couplers. In a uniform long coupler the coupling rolls off when the length exceeds one-quarter wavelength, and only an octave bandwidth is practical for +/−0.3 dB coupling ripple. If three equal length couplers are connected as one long coupler, with the two outer sections being equal in coupling and much weaker than the center coupling, a wideband design results. At low frequencies all three couplings add. At higher frequencies the three sections can combine to give reduced coupling at the center frequency, where each coupler is one-quarter wavelength. This design may be extended to many sections to obtain a very large bandwidth.

Two characteristics exist with the cascaded coupler approach. One is that the coupler becomes very long and lossy, since its combined length is more than one-quarter wavelength long at the lowest band edge. Further, the coupling of the center section gets very tight, especially for 3 dB multi-octave couplers. A cascaded coupler of X:1 bandwidth is about X quarter wavelengths long at the high end of its range. As an alternative, the use of lumped, but generally higher loss, elements has been proposed.

An asymmetrical coupler with a continuously increasing coupling that abruptly terminates at the end of the coupled region will behave differently from a symmetrical coupler. Instead of a constant 90-degree phase difference between the output ports, close to zero or 180 degrees phase difference can be realized. If only the magnitude of the coupling is important, this coupler can be shorter than a symmetric coupler for a given bandwidth, perhaps two-thirds or three-fourths the length.

These couplers, other than lumped element versions, are designed using an analogy between stepped impedance couplers and transformers. As a result, the couplers are made in stepped sections that each have a length of one-fourth wavelength of a center design frequency, and may be several sections long. The coupler sections may be combined into a smoothly varying coupler. This design theoretically raises the high frequency cutoff, but it does not reduce the length of the coupler.

BRIEF SUMMARY OF THE DISCLOSURE

A coupler is disclosed that includes first and second mutually coupled spirals disposed on opposite sides of a dielectric substrate. The substrate may be formed of one or more layers and the coils may have a number of turns appropriate for a given application. Conductors forming the spirals may be opposite each other on the substrate and each spiral may include one or more portions on each side of the substrate.

A coupler is also disclosed that includes first and second conductors formed on opposite sides of a substrate that form a coupled section. The coupled section may include an intermediate portion having a width that is more than the width of end portions. The first and second conductors each may further include an extension extending from and transverse to the respective intermediate portion. The two extensions may extend in non-overlapping relationship.

BRIEF DESCRIPTION OF THE SEVERAL FIGURES

FIG. 1 is a simplified illustration of a spiral-based coupler.

FIG. 2 is a plan view of a coupler formed on a substrate.

DETAILED DESCRIPTION OF VARIOUS EMBODIMENTS

Figure 3:
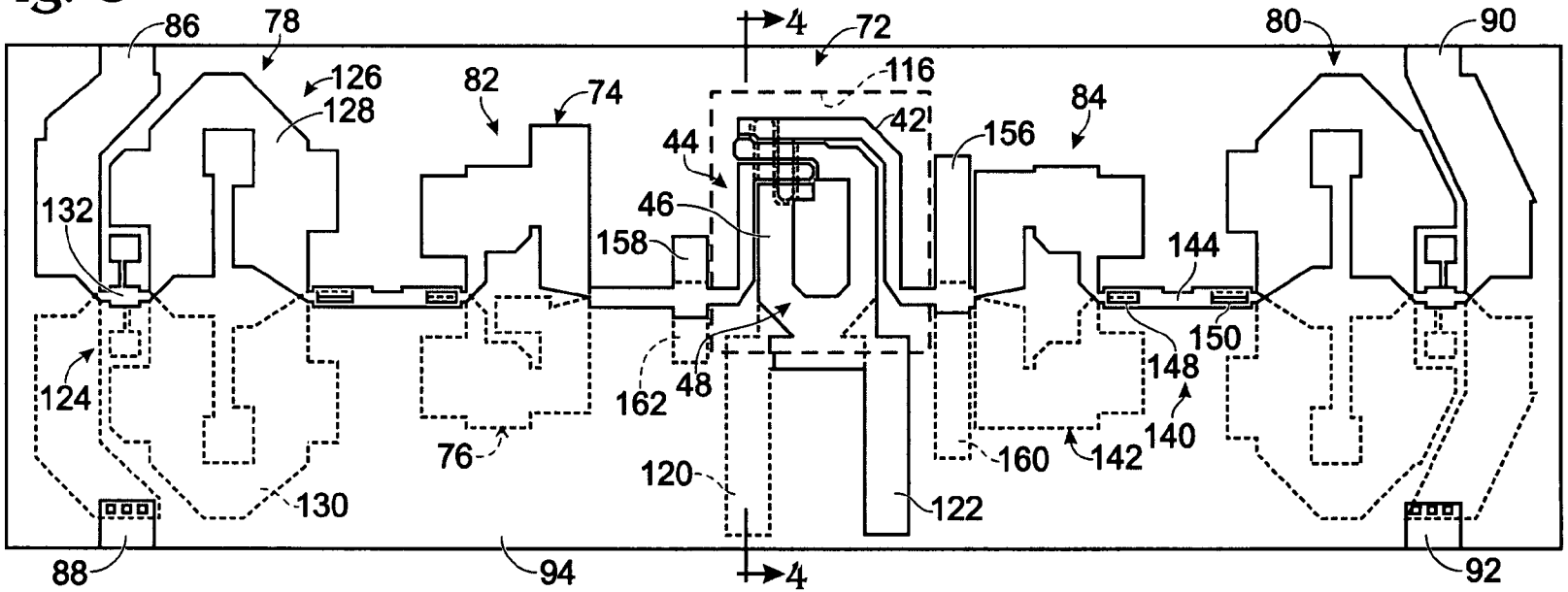
FIG. 3 is a plan view of a coupler incorporating the coupler of FIG. 2.

Two coupled lines may be analyzed based on odd and even modes of propagation. For a pair of identical lines, the even mode exists with equal voltages applied to the inputs of the lines, and for the odd mode, equal out-of-phase voltages this model may be extended to non-identical lines, and to multiple coupled lines. For high directivity in a 50-ohm system, for example, the product of the characteristic impedances of the odd and even modes, e.g., Zoe*Zoo is equal to $Zo^2$, or 2500 ohms. Zo, Zoe, and Zoo are the characteristic impedances of the coupler, the even mode and the odd mode, respectively. Moreover, the more equal the velocity of propagation of the two modes are, the better the directivity of the coupler.

A dielectric above and below the coupled lines may reduce the even-mode impedance while it may have little effect on the odd mode. Air as a dielectric, having a dielectric constant of 1, may reduce the amount that the even-mode impedance is reduced compared to other dielectrics having a higher dielectric constant. However, fine conductors used to make a coupler may need to be supported.

Spirals may also increase the even-mode impedance for a couple of reasons. One reason is that the capacitance to ground may be shared among multiple conductor portions. Further, magnetic coupling between adjacent conductors raises their effective inductance. The spiral line is also smaller than a straight line, and easier to support without impacting the even mode impedance very much. However, using air as a dielectric above and below the spirals while supporting the spirals on a material having a dielectric greater than 1 may produce a velocity disparity, because the odd mode propagates largely through the dielectric between the coupled lines, and is therefore slowed down compared to propagation in air, while the even mode propagates largely through the air.

The odd mode of propagation is as a balanced transmission line. In order to have the even and odd mode velocities equal, the even mode needs to be slowed down by an amount equal to the reduction in velocity introduced by the dielectric loading of the odd mode. This may be accomplished by making a somewhat lumped delay line of the even mode. Adding capacitance to ground at the center of the spiral section produces an L-C-L low pass filter. This may be accomplished by widening the conductors in the middle or intermediate portion of the spirals. The coupling between halves of the spiral modifies the low pass structure into a nearly all-pass "T" section. When the electrical length of the spiral is large enough, such as greater than one-eighth of a design center frequency, the spiral may not be considered to function as a lumped element. As a result, it may be nearly all-pass. The delay of the nearly all pass even mode and that of the balanced dielectrically loaded odd mode may be made approximately equal over a decade bandwidth.

As the design center frequency is reduced, it is possible to use more turns in the spiral to make it more lumped and all-pass, with better behavior at the highest frequency. Physical scaling down also may allow more turns to be used at high frequencies, but the dimensions of traces, vias, and the dielectric layers may become difficult to realize.

FIG. 1 illustrates a coupler 10 based on these concepts, having a first conductor 12 forming a first spiral 14, and a second conductor 16 forming a second spiral 18. Although many spiral configurations may be realized, in the example shown, mutually inductively coupled spirals 14 and 18 are disposed on first and second levels 20 and 22, with a dielectric layer 24 between the two levels. Spiral 14 may include a first or end portion 14*a* on level 20, a second or intermediate portion 14*b* on level 22, and a third or end portion 14*c* on level 20. Similarly, spiral 18 may include a first or end portion 18*a* on level 22, a second or intermediate portion 18*b* on level 20, and a third or end portion 18*c* on level 22. Correspondingly, conductor 12 may have ends 12*a* and 12*b*, and spiral 14 may be considered to be an intermediate conductor portion 12*c*; and conductor 16 may have ends 16*a* and 16*b*, and spiral 18 may be considered to be an intermediate conductor portion 16*c*. Ends 12*a* and 12*b*, and 16*a* and 16*b* may also be considered to be respective input and output terminals for the associated spirals.

Spiral 14 further includes an interconnection 26 interconnecting portion 14*a* on level 20 with portion 14*b* on level 22; an interconnection 28 interconnecting portion 14*b* on level 22 with portion 14*c* on level 20; an interconnection 30 interconnecting portion 18*a* on level 22 with portion 18*b* on level 20; and an interconnection 32 interconnecting portion 18*b* on level 20 with portion 18*c* on level 22. The coupling level of the coupler is affected by pacing D1 between levels 20 and 22, corresponding to the thickness of dielectric layer 24, as well as the effective dielectric constant of the dielectric surrounding the spirals, including layer 24. These dielectric layers between, above and below the spirals may be made of an appropriate material or a combination of materials and layers, including air and various solid dielectrics.

A plan view of a specific coupler 40, similar to coupler 10 and that realizes features discussed above, is illustrated in FIG. 2. Coupler 40 includes a first conductor 42 forming a first spiral 44, and a second conductor 46 forming a second spiral 48. In this example, spirals 44 and 48 are disposed on first and second surfaces 50 and 52 of a dielectric substrate 54 between the two levels. Conductors on hidden surface 52 are identical to and lie directly under (overlap) conductors on visible surface 50, except for those conductors shown in dashed lines. Spiral 44 may include a first or end portion 44*a* on surface 50, a second or intermediate portion 44*b* on surface 52, and a third or end portion 44*c* on surface 50; Similarly, spiral 48 may include a first or end portion 48*a* on surface 52, a second or intermediate portion 48*b* on surface 50, and a third or end portion 48*c* on surface 52. Correspondingly, conductor 42 may have ends 42*a* and 42*b*, and spiral 44 may be considered to be an intermediate conductor portion 42*c*; and conductor 46 may have ends 46*a* and 46*b*, and spiral 48 may be considered to be an intermediate conductor portion 46*c*. Ends 42*a* and 42*b*, and 46*a* and 46*b* may also be considered to be respective input and output terminals for each of the associated spirals.

Spiral 44 further includes a via 56 interconnecting portion 44*a* on surface 50 with portion 44*b* on surface 52; a via 58 interconnecting potion 44*b* on surface 52 with portion 44*c* on surface 50; a via 60 interconnecting portion 48*a* on surface 52 with portion 48*b* on surface 50; and a via 62 interconnecting portion 48*b* on surface 50 with portion 48*c* on surface 52.

Intermediate portions 44*b* and 48*b* of the spirals has a width D2, and end portions 44*a*, 44*c*, 48*a* and 48*c* have a width D3. It is seen that width D3 is nominally about half of width D2. The increased size of the conductors in the middle of the spirals provide increased capacitance compared to the capacitance along the ends of the spirals. As discussed above, this makes the coupler more like an L-C-L low pass filter. Further, it is seen that each spiral has about 7/4 turns. The increased turns over a single-turn spiral, also as discussed, make the spiral function more like a lumped element, and thereby, more of an all-pass coupler.

Coupler 40 may thus form a 50-ohm tight coupler. A symmetrical wideband coupler can then be built with 3, 5, 7, or 9 sections, with the Spiral coupler section forming the center section. The center section coupling may primarily determine the bandwidth of the extended coupler. An example of such a coupler 70 is illustrated in FIGS. 3–6.

Figure 4:
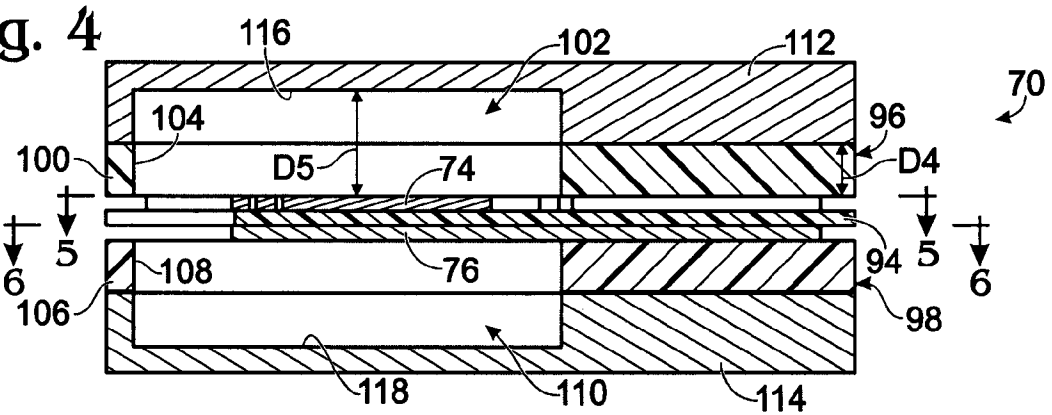
FIG. 4 is a cross section taken along line 4—4 of FIG. 3.
Figure 5:
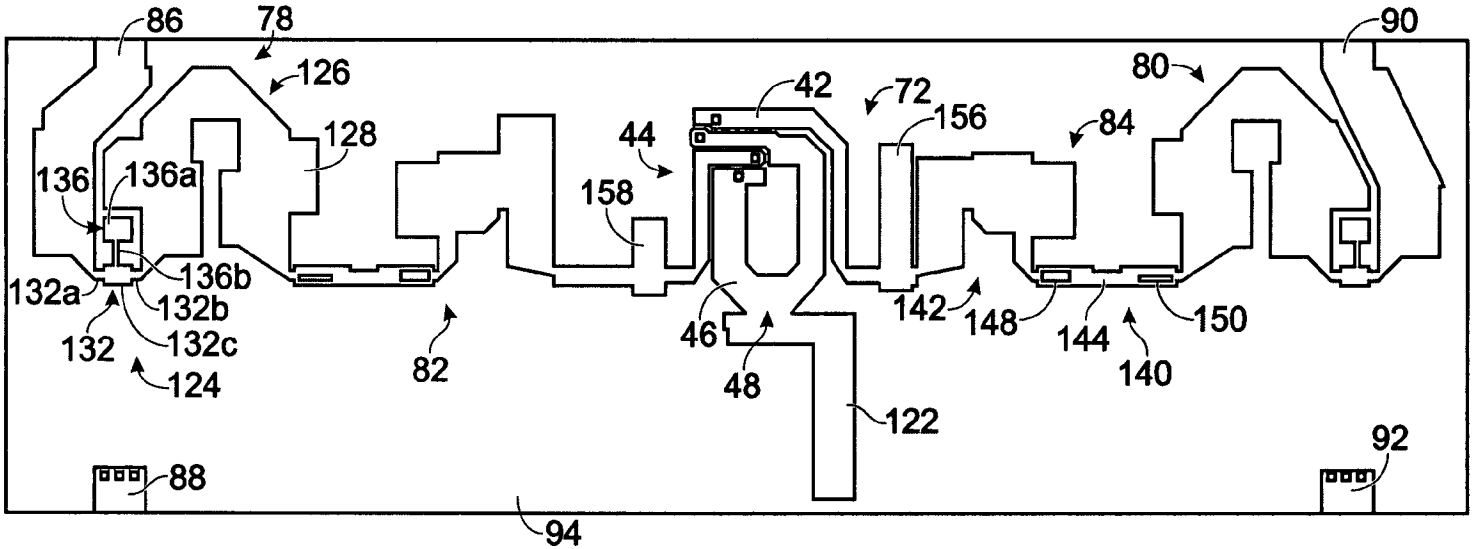
FIG. 5 is a plan view of a first conductive layer of the coupler taken along line 5—5 of FIG. 4.
Figure 6:
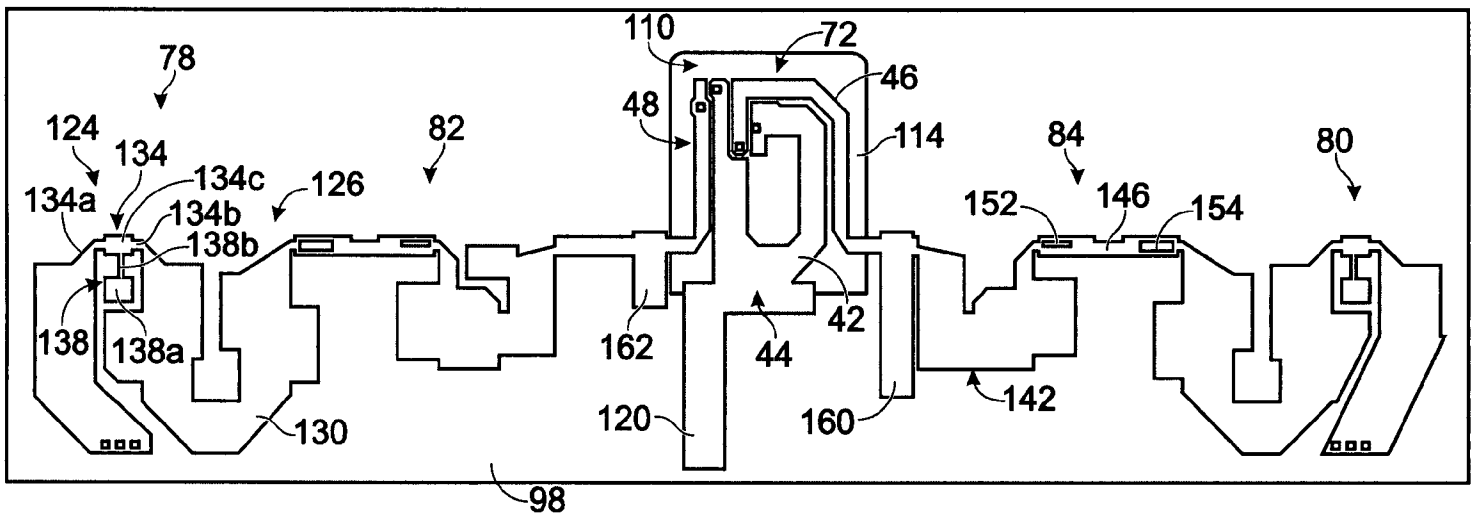
FIG. 6 is a plan view of a second conductive layer of the coupler taken along line 6—6 of FIG. 4.

FIG. 3 is a plan view of coupler 70 incorporating the coupler of FIG. 2 as a center coupler section 72. The reference numbers for coupler 40 are used for the same parts of section 72. FIG. 4 is a cross section taken along line 4—4 of FIG. 3 showing an example of additional layers of the coupler. FIG. 5 is a plan view of a first conductive layer 74 of the coupler of FIG. 3, as viewed along line 5—5 in FIG. 4. FIG. 6 is a plan view of a second conductive layer 76 of the coupler of FIG. 3, as viewed along line 6—6 in FIG. 4 at the transition between the conductive layer and a substrate between the two conductive layers.

Referring initially to FIG. 3, coupler 70 is a hybrid quadrature coupler and has four coupler sections in addition to center section 72. The four additional coupler sections include outer coupler sections 78 and 80, and intermediate coupler sections 82 and 84. Outer section 78 is coupled to first and second ports 86 and 88. Outer section 80 is coupled to third and fourth ports 90 and 92. Ports 86 and 88 may be the input and coupled ports and ports 90 and 92 the direct and isolated ports, in a given application. Depending on the use and connections to the coupler, these port designations may be reversed from side-to-side, or end-to-end. That is, ports 86 and 88 may be the coupled and input ports, respectively, or ports 90 and 92, or ports 92 and 90, respectively, may be the input and coupled ports. Variations may also be made in the conductive layers to vary the location of output ports. For instance, by flipping the metalization of ports 90 and 92, optionally including one or more adjacent coupler sections, the coupled and direct ports 88 and 90 are on the same side of the coupler.

As shown in FIG. 4, coupler 70 may include a first, center dielectric substrate 94. Substrate 94 may be a single layer or a combination of layers having the same or different dielectric constants. In one example, the center dielectric is less than 10 mils thick and is formed of a polyflon material, such as that referred to by the trademark TEFLON™. Optionally, the dielectric may be less than 6 mils thick, With thicknesses of about 5 mils, such as 4.5 mils, having been realized. A circuit operating in the frequency range of about 200 MHz to about 2 GHz has been realized. Other frequencies could also be used, such as between 100 MHz and 10 GHz, or a frequency greater than 1 GHz, depending on manufacturing tolerances.

First conductive layer 74 is positioned on the top surface of the center substrate 94, and second conductive layer 76 is positioned on the lower surface of the center substrate. Optionally, the conductive layers could be self-supporting, or supporting dielectric layers could be positioned above layer 74 and below layer 76.

A second dielectric layer 96 is positioned above conductive layer 74, and a third dielectric layer 98 is positioned below conductive layer 76, as shown. Layer 96 includes a solid dielectric substrate 100 and a portion of an air layer 102 positioned over first and second spirals 44 and 48. Air layer 102 in line with substrate 100 is defined by an opening 104 extending through the dielectric. Third dielectric layer 98 is substantially the same as dielectric layer 96, including a solid dielectric substrate 106 having an opening 108 for an air layer 110. Dielectric substrates 100 and 106 may be any suitable dielectric material. In high power applications, heating in the narrow traces of the spirals may be significant. An alumina or other thermally conductive material can be used for dielectric substrates 100 and 106 to support the spiral at the capacitive middle section, and to act as a thermal shunt while adding capacitance.

A circuit ground or reference potential may be provided on each side of the second and third dielectric layers by respective conductive substrates 112 and 114. Substrates 112 and 114 contact dielectric substrates 100 and 106, respectively. Conductive substrates 112 and 114 include recessed regions or cavities 116 and 118, respectively, into which air layers 102 and 110 extend. As a result the distance D4 from each conductive layer 74 and 76 to the respective conductive substrates 112 and 114, which may function as ground planes, is less than the distance D5 of air layers 102 and 110, respectively. In one embodiment of coupler 70, the distance D4 is 0.062 mils or $1/16^{th}$ inch, and the distance D5 is 0.125 mils or $1/8^{th}$ inch.

As shown particularly in FIGS. 5 and 6, extensions or tabs 120 and 122 extend from respective intermediate spiral portions 44*b* and 48*b* of coupler sections 78 and 80. Tabs 120 and 122 extend from different positions of the spirals so that they do not overlap each other. As a result, they do not affect the coupling between the spirals and increase the capacitance to ground. This forms, with the inductance of the spiral, an all-pass network for the even mode.

Outer coupler sections 78 and 80 are mirror images of each other. Accordingly, only coupler section 78 will be described, it being understood that the description applies equally well to coupler section 80. Coupler section 78 includes a tightly coupled portion 124 and an uncoupled portion 126. This general design is discussed in my copending U.S. patent application Ser. No. 10/607,189 filed Jun. 25, 2003, which is incorporated herein by reference. The uncoupled portion 126 includes delay lines 128 and 130 extending in opposite directions as part of conductive layers 74 and 76, respectively. Coupled portion 124 includes overlapping conductive lines 132 and 134 connected, respectively, between port 86 and delay line 128, and between port 88 and delay line 130. Line 132 includes narrow end portions 132*a* and 132*b*, and a wider intermediate portion 132*c*. Line 134 includes similar end portions 134*a* and 134*b*, and an intermediate portion 134*c*.

Couplers having broadside coupled parallel lines, such as coupled lines 132 and 134, in the region of divergence of the coupled lines between end portions 132*a* and 134*a* and associated ports 86 and 88, exhibit inter-line capacitance. As the lines diverge, magnetic coupling is reduced by the cosine of the divergence angle and the spacing, while the capacitance simply reduces with increased spacing. Thus, the line-to-line capacitance is relatively high at the ends of the coupled region.

This can be compensated for by reducing the dielectric constant of the center dielectric in this region, such as by drilling holes through the center dielectric at the ends of the coupled region. This, however, has limited effectiveness. For short couplers, this excess "end-effect" capacitance could be considered a part of the coupler itself, causing a lower odd mode impedance, and effectively raising the effective dielectric constant, thereby slowing the odd mode propagation.

In the embodiment shown, additional capacitance to ground is provided at the center of the coupled region by tabs 136 and 138, which extend in opposite directions from the middle of respective intermediate coupled-line portions 132*c* and 134*c*. This capacitance lowers the even mode impedance and slows the even mode wave propagation. If the even and the odd mode velocities are equalized, the coupler can have a high directivity. The reduced width of coupled line ends 132*a*, 132*b*, 134*a* and 134*b* raises the even mode impedance to an appropriate value. This also raises the odd mode impedance, so there is some optimization necessary to arrive at the correct shape of the coupled to uncoupled transition When capacitive loading at the center of the coupler is used for velocity equalization.

Tab 136 includes a broad end 136*a* and a narrow neck 136*b*, and correspondingly tab 138 includes a broad end 138*a* and 138*b*. The narrow necks cause the tabs to have little effect On the magnetic field surrounding the coupled section. The shape of the capacitive connection to the center of the coupler is thus like a balloon, or a flag, with the thin flag pole (narrow neck) attached at the center of the coupled region to one conductor on one side of the center circuit board, and to the other conductor on the other side of the circuit board, directly opposite the first flag. It is important that the flags do not couple; therefore they connect to opposite edges of the coupled lines, rather than on top of one another.

Intermediate coupler sections 82 and 84 are also mirror images of each other, so coupler section 84 is described with the understanding that section 82 has the same features. Coupler section 78 includes a tightly coupled portion 140 and an uncoupled portion 142. As seen particularly in FIGS. 5 and 6, tightly coupled portion 140 includes a coupled line 144 in conductive layer 74, and a coupled line 146 in conductive layer 76. Each coupled line in the intermediate coupler sections has a pair of elongate holes, a larger hole and a smaller hole. Specifically, coupled line 144 includes a larger hole 148 adjacent to uncoupled section 142 and a smaller hole 150 at the other end of the coupled line. Coupled line 146 has a smaller hole 152 generally aligned with hole 148 and a larger hole 154 generally aligned with hole 150. Further, the width of each coupled line is reduced in an intermediate region between the holes. These holes reduce the capacitance produced by the coupled lines in the odd mode, while leaving the inductance essentially the same. Similar to coupler section 78, this tends to equalize the odd and even mode velocities in the coupled section.

First and second conductive layers 74 and 76 further have various tabs extending from them, such as tabs 156 and 158 on conductive layer 74, and tabs 160 and 162 on conductive layer 76. These various tabs provide tuning of the coupler to provide desired odd and even mode impedances and substantially equal velocities of propagation of the odd and even modes.

Figure 7:
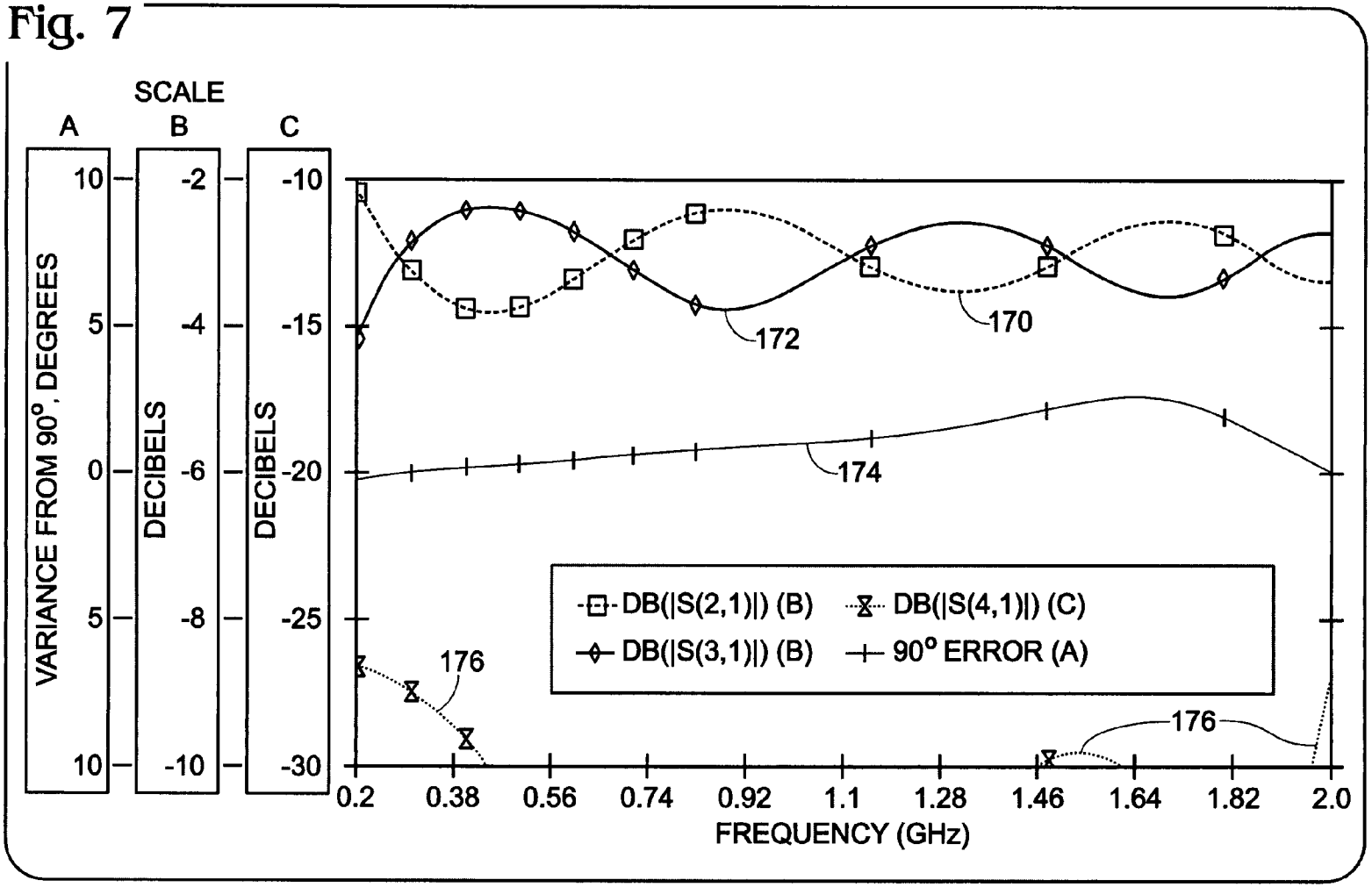
FIG. 7 is a plot of selected operating parameters simulated as a function of frequency for a coupler corresponding to the coupler of FIG. 3.

Various operating parameters Over a frequency range of 0.2 GHz to 2.0 GHz are illustrated in FIG. 7 for coupler 70 with a 5 mil thick dielectric substrate 94 and a 125 mil thickness for air layers 102 and 110. Three scales for the vertical axis, identified as scales A, B and C, apply to the various curves. Curve 170 represents the gain on the direct port and curve 172 represents the gain on the coupled port. Scale B applies to both of these curves. It is seen that the curves have a ripple of about +/−0.5 dB about an average of about −3 dB. As a quadrature coupler, a 90-degree phase difference ideally exists between the direct and coupled ports for all frequencies. Curve 174, to which scale A applies, shows that the variance from 90 degrees gradually reaches a maximum of about 2.8 degrees at about 1.64 GHz. Finally, only a portion of a curve 176 is visible at the bottom of the chart. Scale C applies to curve 176, which curve indicates the isolation between the input and isolated ports. It is seen to be less than −30 dB over most of the frequency range, and below −25 dB for the entire frequency range.

Many variations are possible in the design of a coupler including one or more of the various described features. In particular, for a 3 dB quadrature coupler, coupler sections having designs corresponding to the designs of outer coupler sections 78 and 80 can replace intermediate coupler sections 82 and 84. This design substitution can result in a somewhat reduced length and increased width for these coupler sections and have comparable operating characteristics. Other coupler sections can also be used in coupler 70, such as conventional tightly and loosely coupled sections each having a length of about one fourth the wavelength of a design frequency. Other variations may be used in a particular application, and may be in the form of symmetrical or asymmetrical couplers, and hybrid or directional couplers.

Accordingly, while inventions defined in the following claims have been particularly shown and described with reference to the foregoing embodiments, those skilled in the art will understand that many variations may be made therein without departing from the spirit and scope of the claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present disclosure. The foregoing embodiments are illustrative, and no single feature or element is essential to all possible combinations that may be claimed in this or later applications. Where the claims recite "a", or "a first" element or the equivalent thereof, such claims should be understood to include one or more such elements, neither requiring nor excluding two or more such elements. Further, cardinal indicators, such as first, second or third, for identified elements are used to distinguish between the elements, and do not indicate a required or limited number of such elements, nor does it indicate a particular position or order of such elements.

INDUSTRIAL APPLICABILITY

Radio frequency couplers, coupler elements and components described in the present disclosure are applicable to telecommunications, computers, signal processing and other industries in which couplers are utilized.

What is claimed is:

1. A spiral hybrid coupler comprising:

a dielectric substrate having opposing first and second surfaces; and a first conductor having first and second ends and forming a first spiral between the first and second ends; and a second conductor having third and fourth ends and forming a second spiral between the third and fourth ends;

the first and second conductors being disposed on opposite surfaces of the substrate, the first and second spirals each including a first spiral portion on a respective one of the first and second surfaces and a second spiral portion on the respective other of the first and second surfaces; and the first and second conductors having widths, and the widths of the first and second conductors in the second spiral portions are different than the widths of the first and second conductors in the first spiral portions.

2. A coupler according to claim 1, in which the first and second ends are on the first surface and the third and fourth ends are on the second surface.

3. A coupler according to claim 1, in which the first and second spirals include a third spiral portion on the respective one surface, the respective second spiral portion being electrically between the respective first and third spiral portions.

4. A coupler according to claim 3, in which the widths of the first and second conductors in the second spiral portion are wider than the widths of the first and second conductors in the first and third spiral portions.

5. A coupler according to claim 3, in which the first and second conductors each include an extension extending from and transverse to the portion of the associated conductor forming the second spiral portion, the extensions extending in mutually non-overlapping relationship.

6. A coupler according to claim 1, in which the dielectric substrate is less than 10 mils thick.

7. A coupler according to claim 6, in which the dielectric substrate is less than 6 mils thick.

8. A coupler according to claim 6, in which the first and second spirals are N quarter wavelengths of a design frequency long.

9. A coupler according to claim 8, in which the design frequency is between 100 MHz and 10 GHz.

10. A coupler according to claim 9, in which the design frequency is greater than 1 GHz.

11. A coupler according to claim 1, further comprising a first ground layer generally parallel to and spaced from at least a part of the first portion of the first spiral, and a layer of air separating the part of the first portion of the first spiral from the first ground layer.

12. A coupler comprising:

a dielectric substrate having first and second surfaces; and at least a first coupler section including:

a first spiral including a first spiral portion on the first surface and a second spiral portion on the second surface; and a second spiral including a third spiral portion on the first surface and a fourth spiral portion on the second surface;

the first and second spirals being mutually inductively coupled, and each spiral having an intermediate portion and end portions, with the width of each of the spirals being different in the intermediate portion than in the end portions.

13. A coupler according to claim 12, further comprising a first ground layer generally parallel to and spaced from at least a part of the first portion of the first spiral, and a first layer of air separating the part of the first portion of the first spiral from the first ground layer.

14. A coupler according to claim 13, further comprising a second ground layer generally parallel to and spaced from at least a part of the second portion of the second spiral, and a second layer of air separating the part of the second portion of the first spiral from the first ground layer.

15. A coupler according to claim 13, in which the first ground layer is separated from the part of the first portion of the first spiral by a first distance, the coupler further comprising a second coupler section including a first conductor mounted on the first surface of the dielectric substrate and connected to the first spiral and a second conductor mounted on the second surface of the dielectric substrate and connected to the second spiral, and the first ground layer is spaced from the second coupler section by a second distance less than the first distance.

16. A coupler according to claim 15, further comprising a second dielectric substrate extending between the second coupler section and the first ground layer.

17. A coupler according to claim 15, in which the first and second conductors of the second coupler section extend generally in parallel, and each of the first and second conductors in the second coupler section include an intermediate portion and end portions, with the end portions having a width that is less than the intermediate portion.

18. A coupler according to claim 17, in which the first and second conductors of the second coupler section each further include an extension extending from and transverse to the respective intermediate portion, the two extensions extending in opposite directions.

19. A coupler according to claim 12, further comprising an extension extending from, coplanar with, and transverse to an intermediate portion of each of the first and second spirals, the extensions extending in mutually non-overlapping relationship.

20. A coupler according to claim 19, further comprising a first layer opposite the substrate, having a low dielectric constant disposed adjacent to at least a portion of the first and second spirals, and a thermally conductive second layer opposite the substrate and disposed adjacent to each extension.

21. A coupler according to claim 20, in which the first layer is air.

22. A coupler according to claim 12, in which the first and second spirals are substantially in opposing relationship relative to the dielectric substrate.

23. A coupler according to claim 12, further comprising a second coupler section including a first conductor mounted on the first surface of the dielectric substrate and connected to the first spiral and a second conductor mounted on the second surface of the dielectric substrate and connected to the second spiral.

24. A coupler according to claim 23, further comprising a second dielectric substrate extending between the second coupler section and a first ground layer.

25. A coupler according to claim 23, in which the first and second conductors of the second coupler section extend generally in parallel, and each of the first and second conductors include an intermediate portion and end portions, with the end portions each having a width that is less than the intermediate portion.

26. A coupler according to claim 25, in which the first and second conductors of the second coupler section each further include an extension extending from and transverse to the respective intermediate portion, the two extensions extending in different directions.

27. A coupler according to claim 12, in which the first spiral includes input and output terminals on the first surface, and the second spiral includes input and output terminals on the second surface.

28. A coupler according to claim 12, in which the widths of the spirals are wider in the intermediate portions than in the end portions.

29. A coupler according to claim 12, in which the first spiral includes a fifth spiral portion on the first surface, the fifth spiral portion being separated from the first spiral portion by the second spiral portion.

30. A coupler according to claim 12, in which portions of the first and fourth spiral portions are in directly opposing relationship relative to the dielectric substrate and portions of the second and third spiral portions are in directly opposing relationship relative to the dielectric substrate.

31. A coupler according to claim 12, in which the dielectric substrate is less than 10 mils thick.

32. A coupler according to claim 31, in which the dielectric substrate is less than 6 mils thick.

33. A coupler according to claim 31, in which the first and second spirals are N quarter wavelengths of a design frequency long.

34. A coupler according to claim 33, in which the design frequency is between 100 MHz and 10 GHz.

35. A coupler according to claim 33, in which the design frequency is greater than 1 GHz.

36. A coupler comprising:

a dielectric substrate having opposing first and second surfaces; and a first conductor on the first surface and having first and second ends; and a second conductor on the second surface and having third and fourth ends;

the first and second conductors forming a first coupled section including an intermediate portion and end portions, with each of the end portions having a width that is different than a width of the intermediate portion.

37. A coupler according to claim 36, in which the first and second conductors of the first coupled section each further includes an extension extending from, coplanar with, and transverse to the respective intermediate portion, the two extensions extending in non-overlapping relationship.

38. A coupler according to claim 37, in which the first and second conductors further include an uncoupled section adjacent to the coupled section, the first and second conductors extending in opposite directions in the uncoupled section.

39. A coupler according to claim 38, in which the first and second conductors further form a second coupled section, the uncoupled section being positioned between the first and second coupled sections.

40. A coupler according to claim 37, in which the two extensions extend in opposite directions.

41. A coupler according to claim 37, in which the two extensions include a narrow proximal portion, and a broad distal portion.

* * * * *